US005718506A

United States Patent [19]

Yeh

[11] Patent Number: 5,718,506

[45] Date of Patent: Feb. 17, 1998

[54] FLOOR LAMP SAFETY SHIELD

[76] Inventor: John Yeh, 660 S. Aberdeen, Anaheim Hills, Calif. 92807

[21] Appl. No.: 788,368

[22] Filed: Jan. 27, 1997

[51] Int. Cl.[6] ..... F21V 7/00

[52] U.S. Cl. ..... 362/344; 362/376; 362/410; 362/414

[58] Field of Search ..... 362/263, 344, 362/376, 378, 410, 414, 431

[56] References Cited

U.S. PATENT DOCUMENTS

| | | | |
|---|---|---|---|
| 2,308,071 | 1/1943 | Foss et al. | 362/414 X |
| 4,621,310 | 11/1986 | Keating | 362/344 |
| 5,221,141 | 6/1993 | Swanson | 362/250 |

*Primary Examiner*—Stephen F. Husar
*Attorney, Agent, or Firm*—Francis X. LoJacono

[57] ABSTRACT

The present invention relates to a safety shield or protective cover for halogen lamps particularly halogen floor lamps, whereby the protective safety shield is mounted within an inverted shade device so that flammable objects are prevented from coming in contact with a very hot lighted halogen bulb. The safety shield comprises a substantially rectangular wire framework defined by an arcuate wire support base member that is fixedly attached to a halogen lamp fixture, and wherein the wire support base member includes at least two arcuate rod members transversely affixed thereto so as to cover the halogen lamp fixture, thereby preventing any foreign material from coming in contact with the halogen lamp bulb.

5 Claims, 3 Drawing Sheets

FLOOR LAMP SAFETY SHIELD

BACKGROUND OF THE INVENTION

1. Field of the Invention

The present invention relates generally to a floor lamp and more particularly to a halogen floor lamp having a protective safety shield mounted in the inverted shade device, whereby flammable articles are prevented from coming in contact with a very hot lighted halogen bulb.

2. Description of the Prior Art

As is well known in the art of lamps there are many types and designs, including the more recently introduced lamps which employ halogen lamp bulbs. These bulbs are generally used with the common household electrical 110–130V systems. However, halogen bulbs are provided with very high wattage of from 100W up to 500W and can reach temperatures well over 350°. Therefore, these high watt rated bulbs on occasions have accidentally come in contact with flammable articles such as paper products, cloth material, etc., which can cause almost an instant flash fire.

Thus, a halogen floor lamp that has a typical large diameter bowl-like shade device, hereinafter referred to as an inverted shade, in which the halogen bulb is exposed can readily come in contact with loose articles such as decorative household items and more particularly to freely hung draperies and the like. Accidents have occurred when drapes are windblown so as to come in direct contact with the lamp light fixture. Other types of accidents have been known to cause serious problems such as when a lighted halogen floor lamp or even an open halogen table lamp is inadvertently knocked over and falls on a chair, bed, or other flammable furnishings commonly found in homes or offices.

Since halogen lamps have just recently become very popular such problems as mentioned above have become more frequently known. Thus, there is an urgent need to find a device that allows halogen lamps to be provided with a simple means to prevent the above mentioned problems and related serious accidents from happening without affecting the unique lighting ability, the simplicity of the lamp, and also its aesthetic value.

SUMMARY AND OBJECTS OF THE INVENTION

The present invention comprises a safety shield for a floor lamp having very high wattage lamp bulbs mounted thereon, and more particularly to a safety shield designed for use with floor lamps which include the use of very high wattage halogen lamp bulbs. These bulbs are generally mounted at the top of a floor lamp and are centrally positioned in a shade device which has the appearance of a large diameter bowl. The halogen bulb is removably mounted in a horizontal socket fitting or cradle and is covered with a small elongated glass cover. When the bulb is lighted it becomes very hot in a short time. Because of the heat generated by the halogen lamp bulb it cannot be placed close to a wall or furniture as pointed out above.

Since a bowl-like shade is used, it is generally formed from a sheet metal or from a glass product shaped in a shallow-bowl configuration in which is mounted a metallic reflector housing having an enlarged annular flat top wall, angularly disposed side walls, and a reflective bottom wall. The present invention is defined as a protective safety shield which is mounted to the annular top wall of the reflector housing. The shield can be provided with many different suitable configurations arranged so as to be removably secured to the reflector housing. Preferably the safety shield is formed from a heavy wire structure having a suitable configuration so as not to interfere with the radiating light that is generated by the halogen lamp bulb. The details of the preferred form of the protective safety shield will hereinafter be described in detail.

Accordingly, it is an important object of the present invention to provide a floor lamp and particularly a halogen floor lamp with a protective safety shield, whereby articles or materials of any kind are prevented from entering the approximate area of the surrounding bowl-like shade (inverted shade) in which the halogen lamp bulb is positioned.

Another object of the present invention is to provide a protective safety shield that comprises a wire structure formed with a canopy or dome-like configuration that prevents foreign objects from making any contact with the halogen bulb.

A further object of the invention is to provide a halogen floor lamp wherein the safety shield is provided with a suitable means for removably affixing the shield within the shallow lamp shade, whereby the safety shield in mounted to the reflector structure.

Still another object of the present invention is provide a halogen lamp fixture of this character that is simple in its structure and rugged in construction, as well as inexpensive to manufacture, and yet pleasing in the overall design of the floor lamp structure.

The characteristics and advantages of the invention are further sufficiently referred to in connection with the accompanying drawings, which represents one or more embodiments. After considering these examples, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

The objects and features of the present invention will be further understood with reference to the following detailed description of the illustrated embodiment of the invention, taken together with the accompanying drawings in which.

DESCRIPTION OF THE PREFERRED EMBODIMENTS

Figure 1:
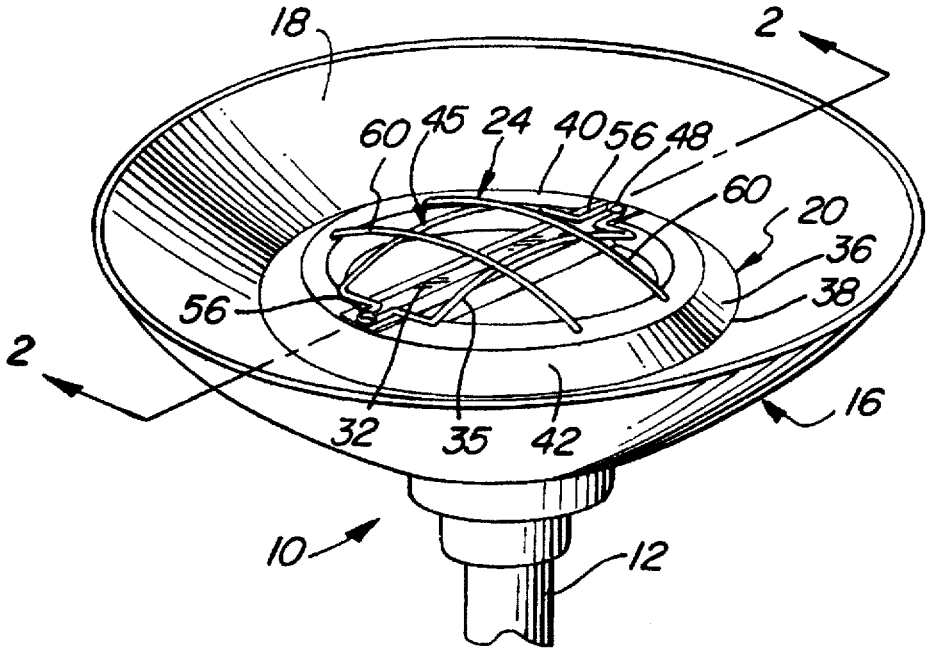
FIG. 1 is a pictorial view of the present invention illustrating the preferred embodiment of a safety shield mounted within the bowl of the halogen lamp affixed to the reflector ring structure of the lamp.

Referring now in more detail to FIGS. 1 through 5, there is shown an upper portion of a halogen floor lamp, generally indicated at 10, which comprises a lamppost 12 fixedly mounted at its lower end to a base member (not shown). A lamp cover or an inverted shade 16 is mounted to the upper end of the lamppost 12 and includes an inner reflecting surface 18 and an annular halogen light fixture 20.

Accordingly, the present invention defines a safety shield, generally indicated at 24, that prevents flammable materials from coming in contact with the halogen light fixture 20. The lamp shield 24 is adapted to be positioned within the lamp cover or inverted shade 16 and is attached to the halogen light fixture 20 so as to provide a protective shield over light fixture 20.

Figure 2:
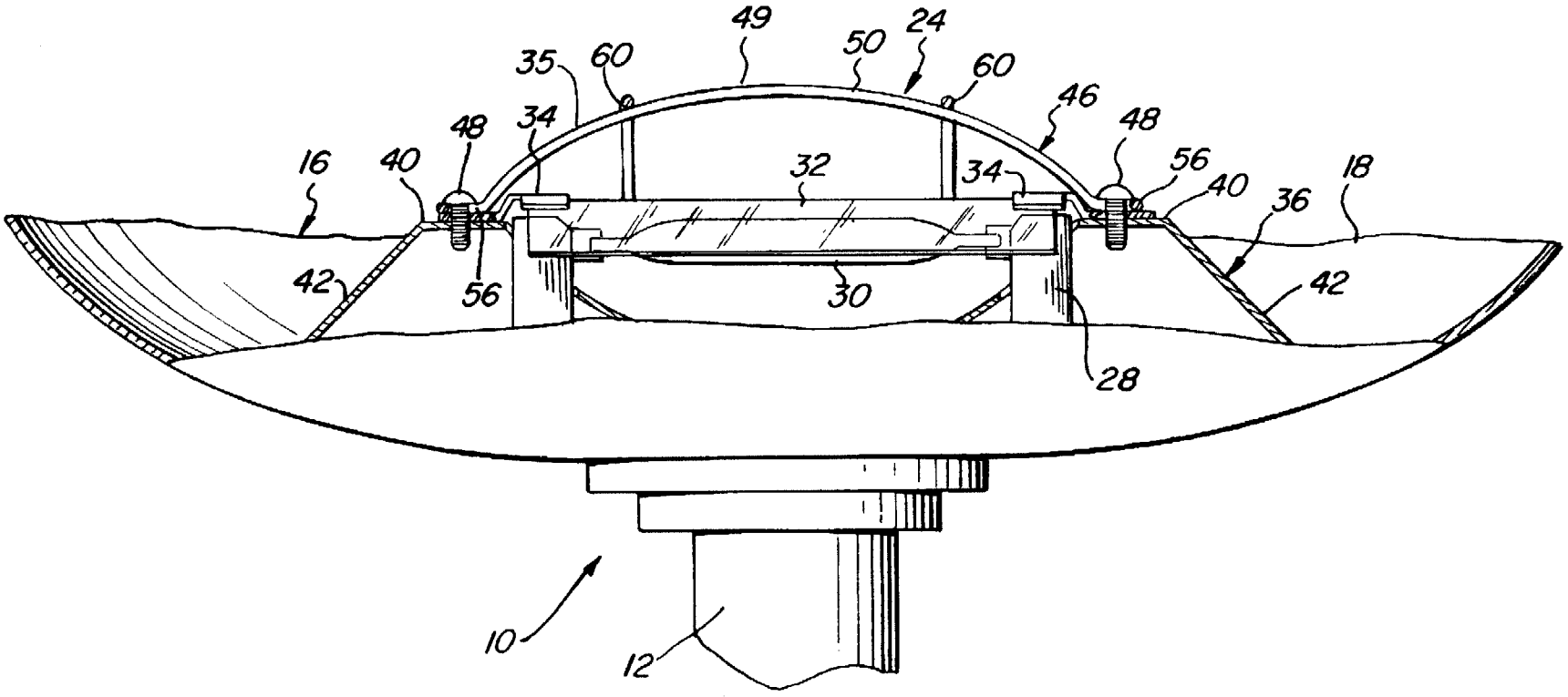
FIG. 2 is an enlarged cross-sectional view of the safety shield mounted to the bowl-like inverted shade, wherein a portion of the inverted shade is broken away.
Figure 3:
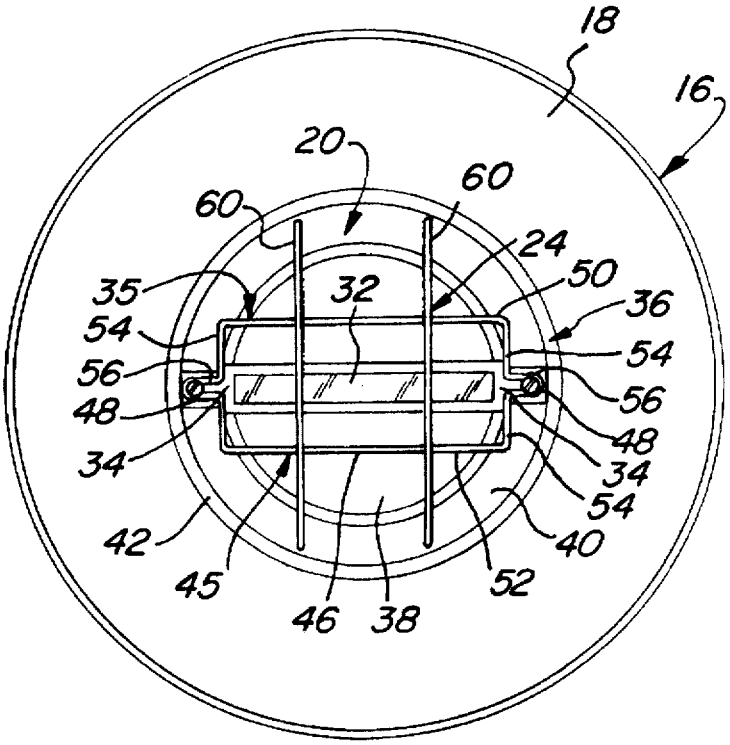
FIG. 3 is a top plan view thereof.
Figure 4:
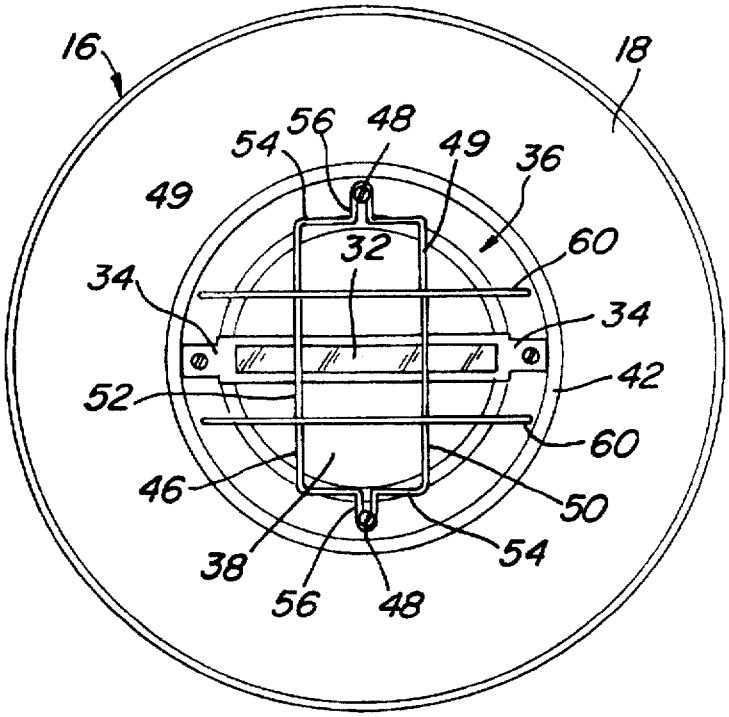
FIG. 4 is another a top plan view illustrating the safety shield in a fixed positioned and rotated 90° from that shown in FIG. 3.

Light fixture 20, as more specifically illustrated in FIG. 2, comprises a halogen light bulb receptacle 28 which is adapted to removably receive a halogen lamp bulb 30 and a glass protective cover 32. The protective cover is secured by a pair of clip members 34 that are fastened to a light reflective support ring 36. The light fixture is also provided with a central parabolic reflective wall 38 that extends upwardly to integrally form an annular top wall 40. The outer peripheral edge of the top wall is defined by an annular inclined wall 42 to which the clip members 34 are secured for holding the glass cover 32 in place over the halogen lamp bulb. This bulb can range between 100w to 500w, thus providing an intense bright light when lit which radiates an extreme high temperature that can inadvertently cause a flash fire when a flammable material comes in contact with a lighted halogen bulb.

Accordingly, the present safety shield 24, as herein disclosed, comprises a wire framework, generally indicated at 45, which is defined by a wire support base member 46 formed by a single strand of wire 35 mounted to the top wall 40 of the light reflective support ring 36 by a suitable fastening means such as screws 48 that screw into the top wall 40, as illustrated in FIG. 2. The base member 46 extends across light fixture 20 and is defined by a substantially rectangular configuration, comprising preferably a single strand of wire that includes a pair of side support strut members 49 that form the elongated side members 50 and 52 which are bent upwardly so as provide an arcuate supporting bridge whereby the strut members 49 terminate as they contact the opposite sides of top wall 40 of the light reflective support ring 36. Side members 50 and 52 are spaced apart from each other and are parallel throughout their length. The side members are bent to define end members 54, each end member being formed having an eyelet 56 which is arranged to receive the respective screw 48 that allows base member 46 to be fixedly secured to the lamp fixture.

Figure 5:
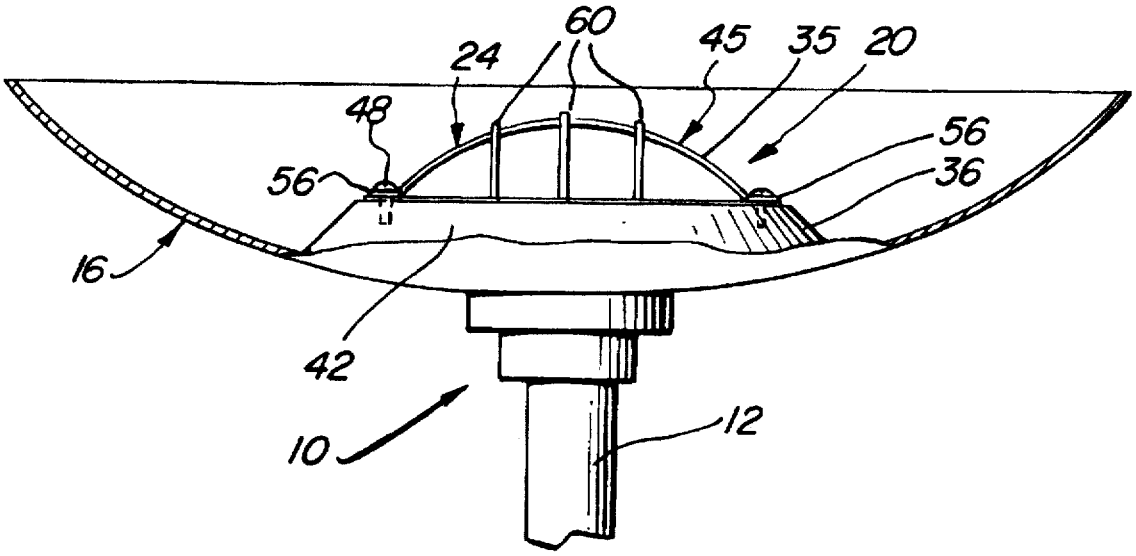
FIG. 5 is a side elevational view of the halogen lamp with the shade thereof being broken away.

The wire framework includes at least two support rods 60 that are fixedly secured transversely by suitable means to side members 50 and 52. Each support rod 60 is also formed having an arcuate configuration whereby each free end of each rod engages the surface of annular top wall 40. Thus, depending on the needs of an individual lamp more support rods may be mounted and equally spaced from each other, as illustrated in FIG. 5.

Thus, the foregoing should only be considered as illustrative of the principles of the invention. Further, since numerous modifications and changes may readily occur to those skilled in the art, it is not desired to limit the invention to the exact construction and operation as shown and described and, accordingly, all suitable modifications and equivalents may be resorted to, falling within the scope of the claimed invention.

What I claim is:

1. In combination, a safety shield for attaching to a halogen light fixture mounted in an inverted shade in which is disposed a halogen lamp bulb that generates an intense heat when lit, wherein said combination comprises:

a halogen floor lamp including an inverted shade mounted at the top of a lamppost;

a halogen lamp light fixture mounted in said inverted shade in which is operably mounted a halogen bulb; said light fixture comprising:

light reflective support ring having an annular top wall and an inclined radial wall;

a halogen light bulb receptacle in which is removably received a halogen lamp bulb and a glass protective cover;

a safety shield comprising:

a wire framework defined by an arcuate wire support base member mounted to said top wall and extending over said halogen light bulb receptacle;

fastening means for attaching said wire framework to said top wall; and at least two arcuate support rods that are fixedly secured transversely to said arcuate wire support base.

2. The combination as recited in claim 1, wherein said arcuate support base member is defined having a substantially rectangular configuration comprising a single strand of wire that includes a pair of arcuate side support strut members so as to be positioned above said halogen light bulb and said glass protective cover.

3. The combination as recited in claim 2, wherein said transverse arcuate support rod members secured in spaced-apart relation to each other and are formed having a length to extend from one side of said light reflective support ring to the opposite side thereof to prevent foreign matter from contacting said halogen light bulb or said glass protective cover.

4. The combination as recited in claim 3, wherein said rectangular arcuate support base member is formed having a pair of oppositely disposed arcuate strut members integrally formed having oppositely disposed end members, each of which is defined by means for securing said a wire framework to said halogen light fixture.

5. The combination as recited in claim 4, wherein said securing means comprises an eyelet formed in each end member of said support base member.

* * * * *